United States Patent [19]

Luborsky et al.

[11] 4,300,950

[45] * Nov. 17, 1981

[54] AMORPHOUS METAL ALLOYS AND RIBBONS THEREOF

[75] Inventors: Fred E. Luborsky, Schenectady; John L. Walter, Scotia, both of N.Y.

[73] Assignee: General Electric Company, Schenectady, N.Y.

[ * ] Notice: The portion of the term of this patent subsequent to Aug. 12, 1997, has been disclaimed.

[21] Appl. No.: 36,197

[22] Filed: May 4, 1979

Related U.S. Application Data

[63] Continuation of Ser. No. 898,482, Apr. 20, 1978, abandoned.

[51] Int. Cl.[3] ..... C22C 38/02

[52] U.S. Cl. ..... 75/123 B; 75/123 L

[58] Field of Search ..... 75/123 B, 123 D, 122, 75/134 F, 123 L

[56] References Cited

U.S. PATENT DOCUMENTS

| | | | |
|---|---|---|---|
| 3,856,513 | 12/1974 | Chen et al. | 75/123 D |
| 4,052,201 | 10/1977 | Polk et al. | 75/122 |
| 4,217,135 | 8/1980 | Luborsky et al. | 75/123 B |

*Primary Examiner*—R. Dean

*Attorney, Agent, or Firm*—Leo I. MaLossi; James C. Davis, Jr.

[57] ABSTRACT

Amorphous metal alloys having good magnetic and physical properties including elevated temperature stability, ductility and saturation flux density contain iron, boron and silicon in proportions of 80–84, 12–15 and 1–8 atom percent respectively.

5 Claims, No Drawings

AMORPHOUS METAL ALLOYS AND RIBBONS THEREOF

The Government has rights in this invention pursuant to Contract No. N00014-76-C-0807 awarded by the Office of Naval Research, Department of the Navy.

This is a continuation of application Ser. No. 898,482, filed Apr. 20, 1978, abandoned. U. S. application Ser. No. 964,621, filed Nov. 29, 1978, U.S. Pat. No. 4,217,135 is a continuation-in-part of U.S. application Ser. No. 898,482, abandoned of which the instant application is a continuation, as noted hereinabove. In view of this relationship, said application Ser. No. 964,621, U.S. Pat. No. 4,217,135 , is also a continuation-in-part of the instant application.

The present invention relates generally to the metal alloy art and is more particularly concerned with novel amorphous metal alloys having a unique combination of magnetic and physical properties, and is further concerned with ribbons and other useful articles made therefrom.

BACKGROUND OF THE INVENTION

While it has been recognized by those skilled in the art that amorphous metals with high saturation magnetization might be used to advantage in electrical apparatus such as distribution and power transformers, such alloys are lacking in necessary ductility and stability for this purpose. Thus, the iron-rich alloy $Fe_{80}B_{20}$ has a $4\pi M_s$ of 15,700–16,100 gauss but begins to crystallize within two hours at about 340° C. and is quite difficult to produce in ductile ribbon form for electrical machinery apparatus. Other amorphous alloys known heretofore have somewhat greater stability and adequate ductility for this purpose, but their saturation magnetization is too low.

SUMMARY OF THE INVENTION

This invention based upon our new concepts to be described enables avoidance of the prior art necessity of choosing between desired magnetization and physical properties in amorphous metals. In other words, it is now possible by virtue of this invention to provide an amorphous metal in the form of a ribbon sufficiently ductile to be readily used in electrical apparatus construction which has good magnetic properties and elevated temperature stability. Moreover, this unique combination of properties of special merit in terms of potential utility of amorphous metals in the general field of electric power generation, transmission and utilization can be obtained without incurring any offsetting disadvantage.

This new result is the consequence of our finding that saturation magnetization of an amorphous metal alloy is influenced by the number of electrons available from the glass former constituents of the alloy. It is also the consequence of our observation that the stability of such alloys improves as a greater variety of glass forming atoms are included in them. Thus, we have found that although the binary alloy $Fe_{80}B_{20}$ is difficult to prepare as a high ductility amorphous ribbon, small additions of a second glass forming atom may help formulation of very ductile ribbons under ribbon forming conditions which are otherwise the same.

We have further found that while additions of silicon to $Fe_{80}B_{20}$ reduces $4\pi M_s$ because silicon has more available electrons than boron, the improvement in ductility is great and the saturation magnetization is only marginally diminished. Moreover, stability against crystallization tendency at elevated temperature is substantially improved in each instance where boron is substituted in part by silicon in alloys containing from 80 to 84 atom percent iron. In such alloys, silicon varies from 1 to 8 atom percent while boron ranges from 12 to 16 atom percent. Further, in accordance with the broad, general concept of this invention, phosphorus, aluminum, carbon and even sulfur can be used under certain conditions in combination or individually with silicon to obtain the new results and advantages stated above. According to that concept, such use in every instance must be made without diminishing the alloy iron content below about 80 atom percent. Likewise, the silicon content minimum in the alloys of this invention is about one atom percent. The maximum phosphorus and sulfur contents, both individual and combined, should not exceed 0.5 atom percent. The penalty for violating these limits is substantial loss of one or more of the desired magnetic or physical properties.

Briefly described, this invention in its composition aspect consists of an amorphous metal alloy of iron, boron and silicon having an unique combination of desired physical and magnetic properties including ductility, elevated temperature stability and saturation flux density by virtue of the fact that the alloy contains from 80 to 84 atom percent iron, from 12 to 15 atom percent boron and from 1 to 8 atom percent silicon.

This invention in its article aspect consists of the novel alloy defined just above in the form of a ribbon suitable for use, for example, in the construction of the magnetoelectric component of motor, generator, transformer or other electrical apparatus.

DETAILED DESCRIPTION OF THE INVENTION

In practicing this invention, novel alloys defined above and claimed herein are prepared suitably by mixing together the alloy constituents in the required proportions in the form of powders and then melting the mixture to provide molten alloy for casting to ribbon of the desired dimensions. The casting operation is preferably carried out through the use of the method disclosed and claimed in copending application Ser. No. 885,436, filed Mar. 10, 1978 and now abandoned, in the name of John Lee Walter and assigned to the assignee hereof. The apparatus described in that application as implementing the therein-claimed method may likewise be used to provide long lengths of ribbons of this invention of uniform width and thickness and smooth edges and surfaces. Cooling is carried out in the casting operation at a rate sufficient to produce amorphous material.

While variations in melting-point temperatures between alloys of this invention may impose requirements which vary with respect to alloy melting and casting operations, the preparation and processing of these alloys can be carried out with uniformly satisfactory results by following the above procedure and using the described equipment. In other words, the results of this invention are reproducible in a substantially routine manner so long as the compositional limitations stated above and in the appended claims are strictly observed in the preparation of the alloys.

Those skilled in the art will gain a further and better understanding of this invention from the following illustrative, but not limiting, examples of the actual practice of the invention and comparative experiments carried out upon amorphous metals standing outside the critical limits of compositions of this invention.

EXAMPLE I

A ribbon of approximately 0.0025 cm thick by 0.13 cm wide of $Fe_{80}B_{20}$ alloy was produced by directing a stream of the alloy onto the surface of a rapidly revolving chill roll or drum as described in Example I of the aforesaid copending Pat. application Ser. No. 885,436, abandoned. The amorphous nature of the resulting ribbon was confirmed by X-ray diffraction, differential scanning calorimetry and by magnetic and physical property measurements. The degree of ductility was determined by measuring the radius of curvature at which fracture occurred in a simple bend test between parallel plates. Ribbon segments were annealed in purified nitrogen for two hours at temperatures ranging from 100° C. to 400° C. The crystallization temperature was taken as that temperature, for the two-hour anneal, at which the coercive force abruptly increased. Saturation magnetization and Curie temperature were obtained by conventional induction techniques as described in *Applied Physics*, Vol. 29, p. 330, 1976, and *Scripta Met.*, Vol. 11, p. 367, 1977. The results of these tests and those conducted on the ribbons produced as described below in Examples II through VII are set out in Table I.

EXAMPLE II

A ribbon of $Fe_{40}Ni_{40}P_{14}B_6$ was prepared and tested as described in Example I or in the results set forth in Table I.

EXAMPLE III

Still another amorphous metal alloy ribbon of composition $Fe_{40}Ni_{40}B_{20}$ was prepared and tested as described in Example I with the results stated in Table I.

EXAMPLE IV

A ribbon of $Fe_{84.5}B_{15}P_{0.5}$ was prepared and tested as stated in Example I with the results shown in Table I.

EXAMPLE V

A ribbon of $Fe_{84}B_{15}Si_1$ was prepared and tested as described in Example I with the results shown in Table I.

EXAMPLE VI

Another test ribbon of the physical specifications of Example I but of composition $Fe_{80}B_{16}Si_4$ was prepared and tested as to stability with the result shown in Table I.

EXAMPLE VII

Another test ribbon of $Fe_{84}B_{16}$ was prepared and tested as to stability with the results set out in Table I.

EXAMPLE VIII

Finally, a ribbon of the physical specifications of Example I of $Fe_{80}B_{12}Si_8$ was prepared and tested as to stability with the results stated in Table I.

TABLE I

| Alloy | Yield Strain $\lambda_y$ | $T_B$ °C. | $T_x$ °C. | $M_s$ @ R.T. kG | $T_c$ °C. |
|---|---|---|---|---|---|
| $Fe_{40}Ni_{40}P_{14}B_6$ | 0.018 | <100 | 352 | 7.9 | 255 |
| $Fe_{40}Ni_{40}B_{20}$ | 0.018 | 240 ± 5 | 358 | 10.4 | 396 |
| $Fe_{84}B_{16}$ | — | — | 300 | 15.6 | 320 |
| $Fe_{84.5}B_{15}P_{0.5}$ | 0.022 | 245 ± 5 | 303 | 15.4 | 312 |
| $Fe_{84}B_{15}Si_1$ | 0.022 | 295 ± 5 | 304 | 15.4 | 373 |
| $Fe_{80}B_{20}$ | 0.021 | 273 ± 5 | 343 | 16.1 | 382 |
| $Fe_{80}B_{16}Si_4$ | — | — | 380 | 15.3 | 390 |
| $Fe_{80}B_{12}Si_8$ | — | — | 380 | 14.9 | 400 |

$T_x$-Temperature for initiation of crystallization in 2 hr. anneal
$M_s$-Saturation flux density
$T_c$-Curie temperature
$\lambda_f = t/(2r_f - t)$; $\lambda_y$ is the yield strain obtained from the value of r at which plastic deformation was first observed.
$T_B$-Temperature for initiation of embrittlement in 2 hr. anneal As shown by the tabulated data gathered during these tests, the temperature at which embrittlement $T_B$ occurs is highest for the ternary composition $Fe_{84}B_{15}Si_1$ and the inclusion of a small amount of phosphorus sharply reduces the embrittlement temperature. The ductility of the single metalloid alloys is greater than that of the alloys containing two metalloids, and that of $Fe_{84}B_{15}Si_1$ and $Fe_{84.5}B_{15}P_{0.5}$ are greatest of the test group. The stability towards embrittlement and towards crystallization of the alloys is at a maximum in the alloys containing two metalloids and at a minimum in single metalloid alloys of these series. The saturation magnetization in the two-metalloid alloys of these series compares favorably with the maximum value of $Fe_{80}B_{20}$. Outstanding stability is exhibited by the $Fe_{80}B_{16}Si_4$ and $Fe_{80}B_{12}Si_8$ alloys.

What we claim as new and desire to secure by Letters Patent of the United States is:

1. An iron-boron-silicon amorphous metal alloy having an unique combination of physical and magnetic properties including ductility, elevated temperature stability and saturation flux density, said alloy consisting essentially of from 80 to 84 atom percent iron, from 12 to 15 atom percent boron and from one to eight atom percent silicon.

2. The alloy of claim 1 of the formula $Fe_{80}B_{12}Si_8$.

3. The alloy of claim 1 of the formula $Fe_{84}B_{15}Si_1$.

4. As an article of manufacture, a ribbon of amorphous metal alloy of claim 1.

5. As an article of manufacture, a ribbon of the composition of claim 3.

* * * * *